US008353187B2

(12) United States Patent
Woodling

(10) Patent No.: US 8,353,187 B2
(45) Date of Patent: Jan. 15, 2013

(54) PADLOCK DEVICE USING AN ELECTROMAGNETIC SWITCH ACTUATED SYSTEM WITH FINGERPRINT IDENTIFICATION SYSTEM

(76) Inventor: Yiqi Wu Woodling, Carmel, IN (US)

( * ) Notice: Subject to any disclaimer, the term of this patent is extended or adjusted under 35 U.S.C. 154(b) by 398 days.

(21) Appl. No.: 12/574,011

(22) Filed: Oct. 6, 2009

(65) Prior Publication Data

US 2010/0083713 A1 Apr. 8, 2010

Related U.S. Application Data

(60) Provisional application No. 61/195,438, filed on Oct. 7, 2008.

(51) Int. Cl.
*E05B 49/00* (2006.01)

(52) U.S. Cl. ..... 70/278.7; 70/20; 70/38 B; 70/275; 70/278.1

(58) Field of Classification Search ..... 70/20, 23, 70/38 B, 275, 277, 278.1, 278.7, 31, 35, 38 R, 70/38 A, 39
See application file for complete search history.

(56) References Cited

U.S. PATENT DOCUMENTS

| | | | | |
|---|---|---|---|---|
| 5,216,909 | A * | 6/1993 | Armoogam | 70/278.7 |
| 6,046,558 | A * | 4/2000 | Larson et al. | 70/277 |
| 6,401,501 | B1 * | 6/2002 | Kajuch et al. | 70/25 |
| 7,043,060 | B2 * | 5/2006 | Quintana | 382/124 |
| 7,076,976 | B1 * | 7/2006 | Goldman | 70/33 |
| 7,316,141 | B2 * | 1/2008 | Goldman | 70/278.7 |
| 7,423,515 | B1 * | 9/2008 | Fiske et al. | 70/416 |
| 2003/0016847 | A1 * | 1/2003 | Quintana | 382/124 |
| 2004/0255623 | A1 * | 12/2004 | Sun et al. | 70/38 A |
| 2007/0126551 | A1 * | 6/2007 | Slevin | 70/277 |
| 2008/0012686 | A1 * | 1/2008 | Bonestroo | 70/38 A |
| 2009/0015121 | A1 * | 1/2009 | Sampson | 312/242 |
| 2011/0090047 | A1 * | 4/2011 | Patel | 340/5.82 |

FOREIGN PATENT DOCUMENTS

JP 2002206361 A * 7/2002

* cited by examiner

*Primary Examiner* — Christopher Boswell

(57) ABSTRACT

A keyless padlock system includes an electromagnetic switch system and a fingerprint process system. The electromagnetic switch system operates the padlock with a mechanical actuated mechanism. The system also secures the padlock against the force and vibration. The fingerprint process system provides the padlock device an easy operation as the key system. The buttons and LED's manage using both fingerprint and the combination code. A changeable battery system without losing the memory provides the padlock device a reliable and easy application.

10 Claims, 8 Drawing Sheets

PADLOCK DEVICE USING AN ELECTROMAGNETIC SWITCH ACTUATED SYSTEM WITH FINGERPRINT IDENTIFICATION SYSTEM

This application claims the benefit of my early filed Provisional Application # U.S. 61/195,438: filed on Oct. 7, 2008.

BACKGROUND OF THE INVENTION

1. Field of the Invention

The present invention generally uses an electromagnetic switch system with a dual fingerprint and combination code identification system on to the padlock mechanism as an electrical, optical, and mechanical padlock device without a physical key. It also included to the padlock on the electromagnetic switch operated a mini actuating mechanism.

2. Description of Related Art

Using a regular single electromagnetic switch on a padlock, the locking system cannot keep the locking part at a safe locking position. The present invention provides the dual electromagnetic switch that contains the security locking switch system to the padlock. And some of fingerprint lock system with an electronic motor lock system has a high cost, thus a minimum market. The present invention will provide the users a safe, reliable, easy to use and cost effective padlock device. With a key operated padlock system, people may have the problem of a lost key. At the keyless padlock system people may have a trouble on the fingerprint or forgetting the comb number. The dual identification system of the combination code and fingerprint will provide the more solution for the application of the padlock.

SUMMARY OF THE INVENTION

Briefly and in general terms, the present invention provides a new and improved system and method for using an electromagnetic switch system and dual fingerprint and code identification system to a padlock device.

It is a particular object of the present invention to have an improved electromagnet switch contains the security locking switch system. It is still another particular object of the present invention to provide a dual electromagnet switch connected with the actuated mechanical operation system to the padlock device. More particularly, in an embodiment of the present invention, padlock device is provided for using the buttons operating the dual fingerprint management and combination code access system, the LED indicates the operation and the changeable battery without loss the memory of fingerprint installed. It is a further object of the present invention to have both user and manufactory access code though the fingerprint microprocessor system to the padlock.

DETAILED DESCRIPTION OF PREFERRED EMBODIMENTS

The present invention is directed to an improved system and method for providing a user of a traditional padlock usage, but easy and convenient. The preferred embodiments of the improved system and method are fully and detailed illustrated and described in the following paragraphs.

Figure 1:
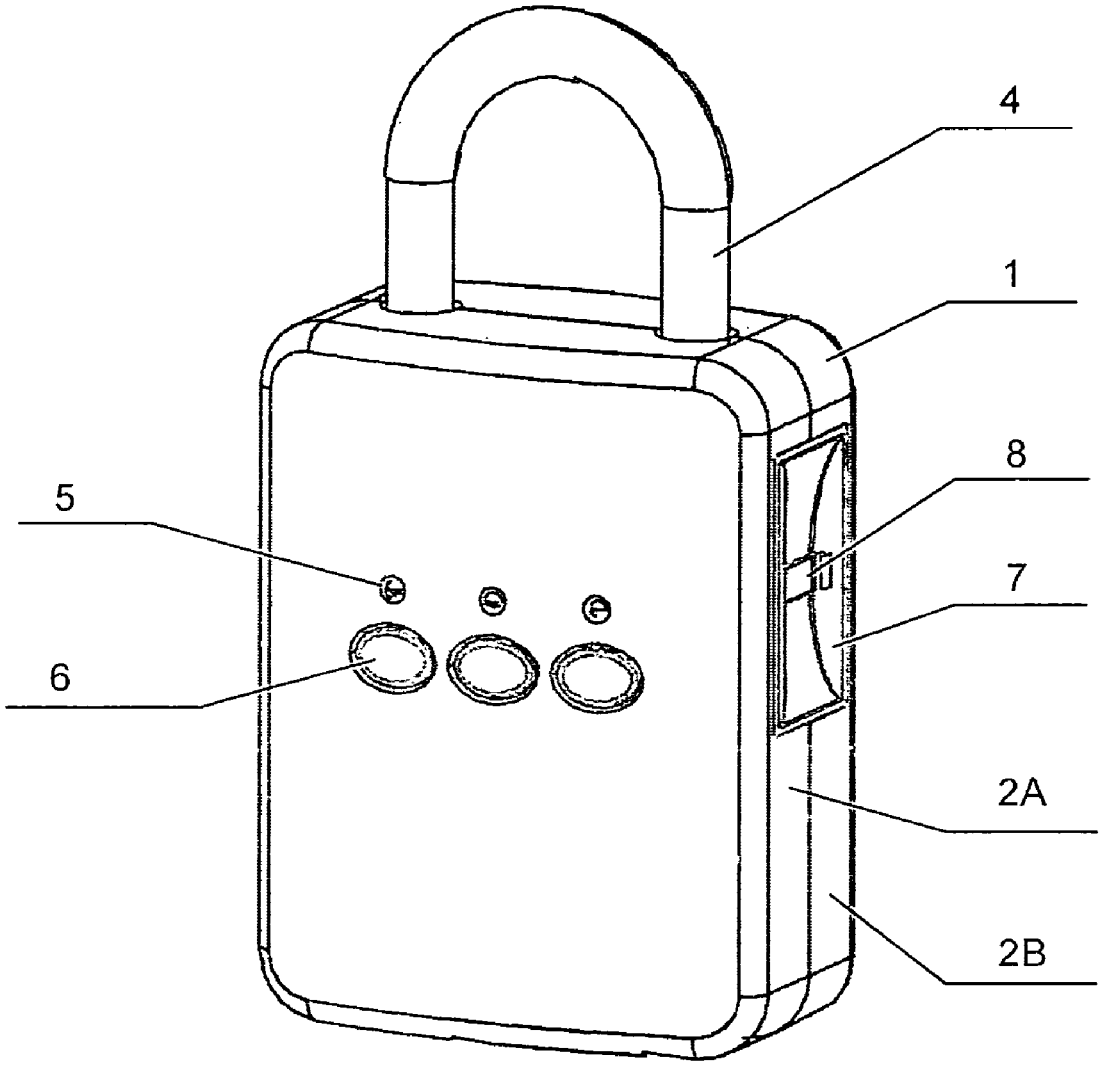
FIG. 1 is an isometric view of padlock device of the present invention shown the front side of the buttons and LED's, shown the aside of the fingerprint sensor and sensor frame.

As shown in FIG. 1, the present invention relates to all types of padlocks having a shackle-type locking 4 means held in a locking position within housing 2. The front of housing 2A has 3 buttons 6 and 3 LED's 5 to operate and indicate the padlock device 1 for the fingerprint installation and management. The user can access the combination code though the buttons 6. The manufacture uses the buttons 6 to control and manage the padlock device with the set-up code from software. The user can install and manage the fingerprint with the buttons 6 following the LED's 5 indication.

The fingerprint sensor 8 shows at the side of the padlock device 1 on FIG. 1. The user can use any finger to slide though the slot on the sensor frame 7 to install or open the padlock device. It gives a safe position to fingerprint sensor 8 and a convenient operation position to user.

Figure 2:
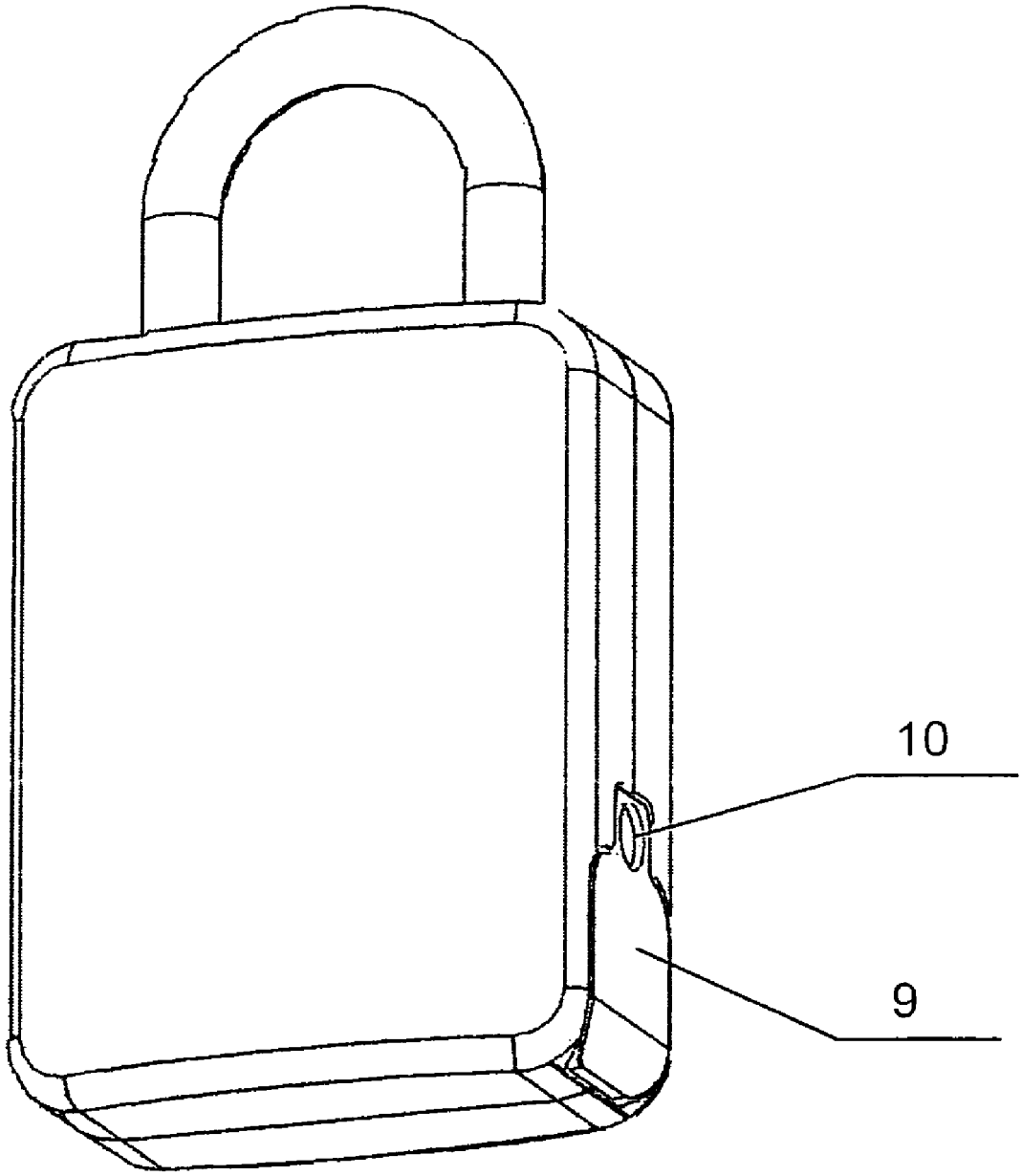
FIG. 2 is an isometric view of padlock device of the present invention shown from the back and bottom side of view which has the battery door and the screw to lock the door.

At the bottom corner of padlock device 1 of present invention shown on FIG. 2, there is a battery door 9 covering the battery 18 inside of the housing 2 using a screw 10 and screwdriver. The batteries 18 inside of case can be exchanged without affecting the existing fingerprints function.

Figure 3:
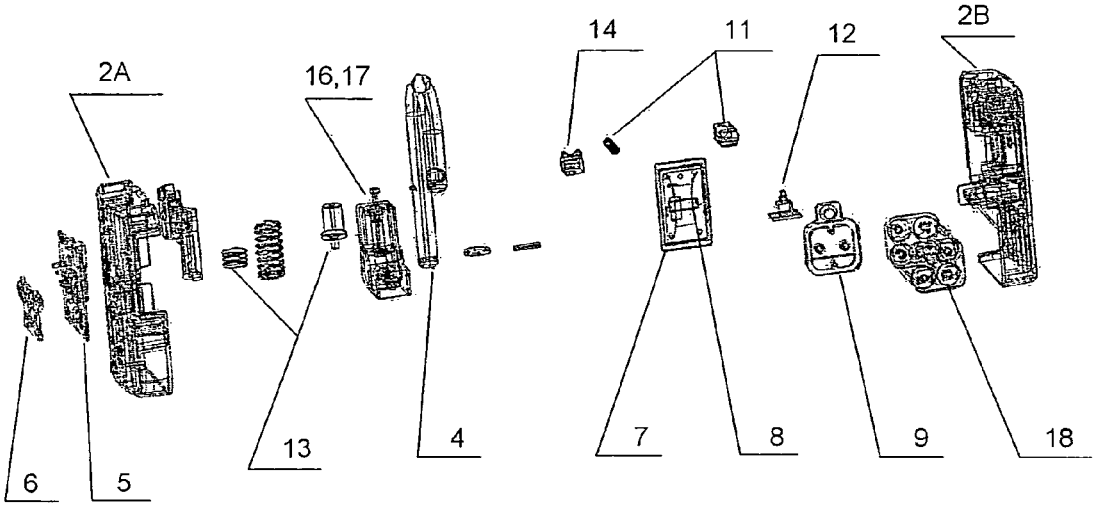
FIG. 3 is an exploded perspective view of a padlock device of the present invention, including an electromagnetic switch system, shackle, sliding block, support block, battery and battery door, fingerprint sensor, PCB and padlock device housing.

Referring to the FIG. 3, in an exploded view of the embodiment of the invention it shows the mechanical mechanism and electromagnetic switch 16, 17 at the inside of padlock device 1. The PCB mounted for the LED 6, button 6 switches contains microprocessor. It connects the power of the electromagnetic switch with the battery 18. It also has the connection to the fingerprint sensor 8. The battery 18 and fingerprint sensor 8 are completely isolated by the housing 2 and plastic case with the electromagnetic switch system and other mechanical mechanism of the padlock.

Figure 4:
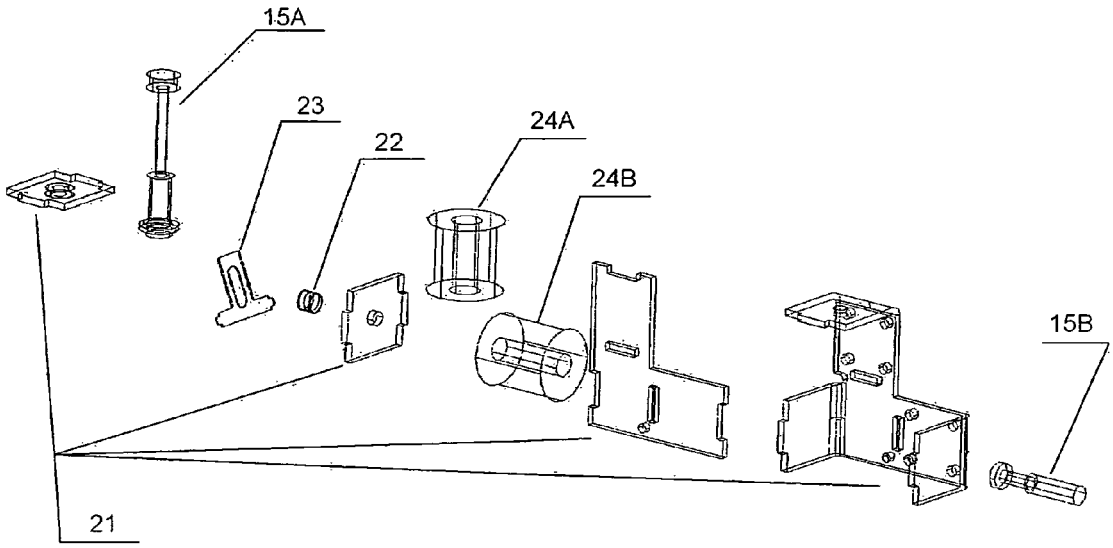
FIG. 4 is an exploded perspective view of an electromagnetic switch system of the present invention that shows the detail structure of major, minor switch and stop plate.

As shown in FIG. 4, there shown is the mechanism of the electromagnetic switch system of the padlock of the present invention. The rod 15A assembled to the major electromagnetic switch 16 retracted into the solenoid and magnetic body 24A when the unlocking signal tuned on. The magnetic body 24A holds the rod 15A until the locking signal push the rod 15A back to the locking position. The minor electromagnetic switch 17 retract the rod 15B to the solenoid body 24B and pull the stop plate 23 back and squeeze the spring 22 following the rod 15B after receive the unlocking signal. The rod 15B and the stop plate 23 will be released by spring 22 after the signal off. The minor electromagnetic switch 17 has to work before the major electromagnetic switch 16 has the action. The microprocessor controls the signals in the fingerprint process system.

Figure 5:
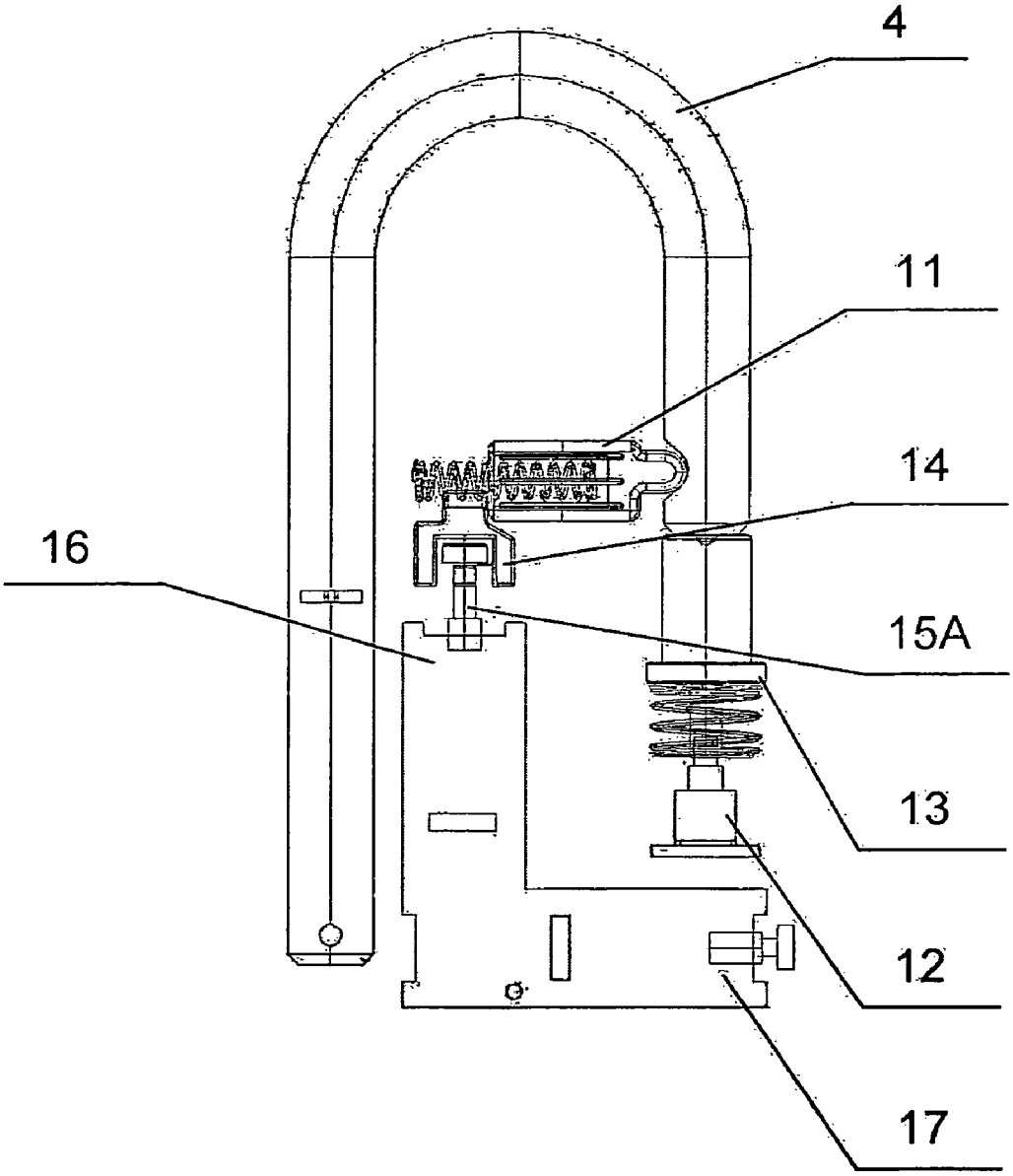
FIG. 5 is a sketched front view of embodiment of the shackle actuating and locking mechanism inside of padlock device of the present invention.

Turning to FIG. 5, there shown is an internal structure at the locking and unlocking position of the padlock of the present invention. The electromagnetic switch system 16, 17 work by on or off signal from microprocessor. When unlocking signal is on, the end cap 14 follow the rod 15A slides off the sliding block with the end spring 11. The sliding block with the end spring 11 moves free from the shackle 4. The user can pull the shackle 4 to open the padlock.

When the user push the shackle 4 into the housing as normal padlock to lock the padlock, the return block with the return spring 13 act to the return switch 12 which will give a locking signal to push the rod 15A back to the locking position. The sliding block is pushed by shackle 4 and spring back to the locking position at the same operation process.

A sliding block with the end spring 11 has the 90-degree motion with the shackle 4. When the notch on shackle 4 blocked by the sliding block with the end spring 11, the padlock device will be locked. When the notch on shackle 4 has not blocked by the sliding block with the end spring 11, the shackle 4 can be moved up and down. The user has to pull or push the shackle to unlock or lock the padlock device 1.

Figure 6:
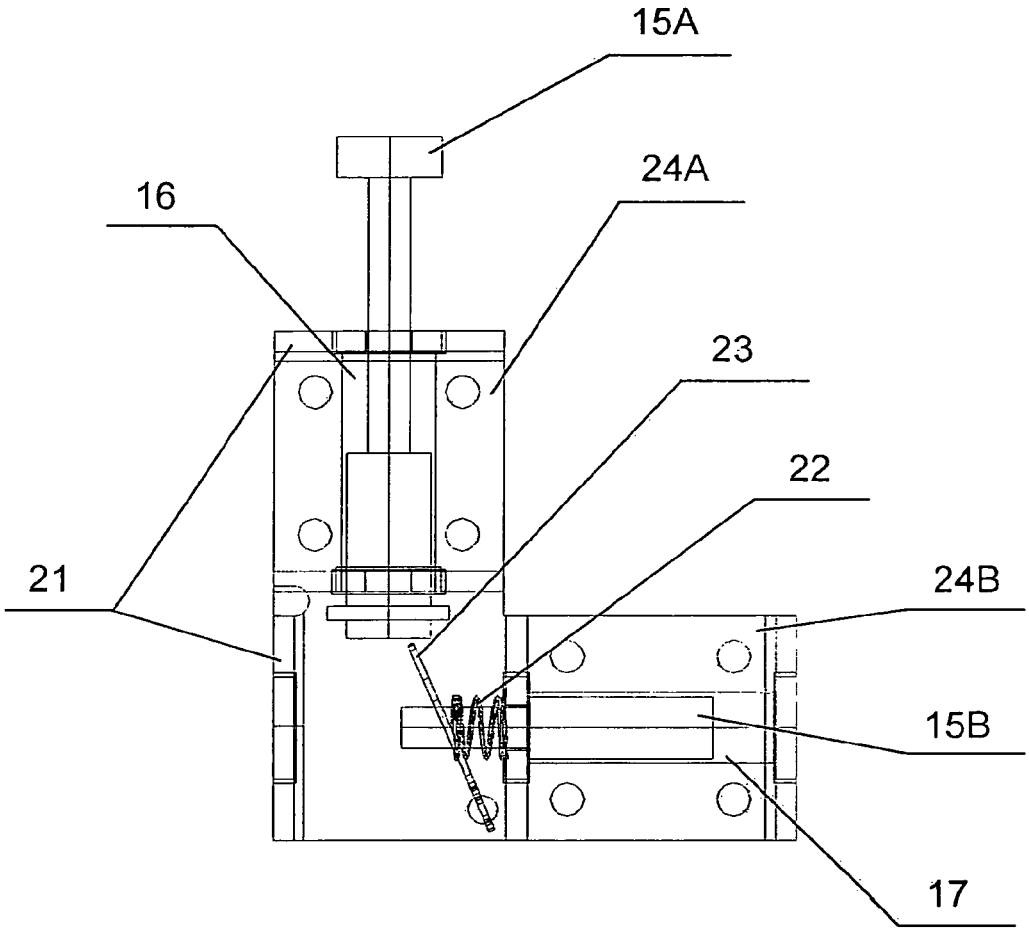
FIG. 6 is a sketched front view of the electromagnetic switch system of the present invention.

As shown on FIG. 6, the electromagnetic switch system 16, 17 contain one major switch 16, the stop plate 23 and one minor switch 17. The minor switch 17 using the unlock signal and using the spring force has the function applied to the stop plate 23 and let it move on or off at the end of rod 15A of the major electromagnetic switch 16. The rod 15A cannot drop into the magnetic body 24A when the rod 15A holds the end cap and sliding block at the locking position of the padlock due to the stop plate 23 against the rod 15A. In other words the padlock device 1 of the present invention remains in the locking position securely with any force or vibration.

On the present invention, the padlock device is operated by fingerprint. The user's finger push the button 6; the LED light will be on and shows the lock status. One LED if red light means the padlock has the fingerprint exist and is ready for the operation; second LED light if green means the padlock is confirmed the operation. Both LED if red and green lights on means that there is no fingerprint exist and are ready for the operation. If there is not operation at the device for a certain time, the LED will be off for power saving. If the battery 18 drains at the lower or dead situation, the LED if red light will be on flashing. This means that the user has to change the battery 18 to continue using. The existing fingerprint will be in effect after installation of the new battery.

Figure 7:
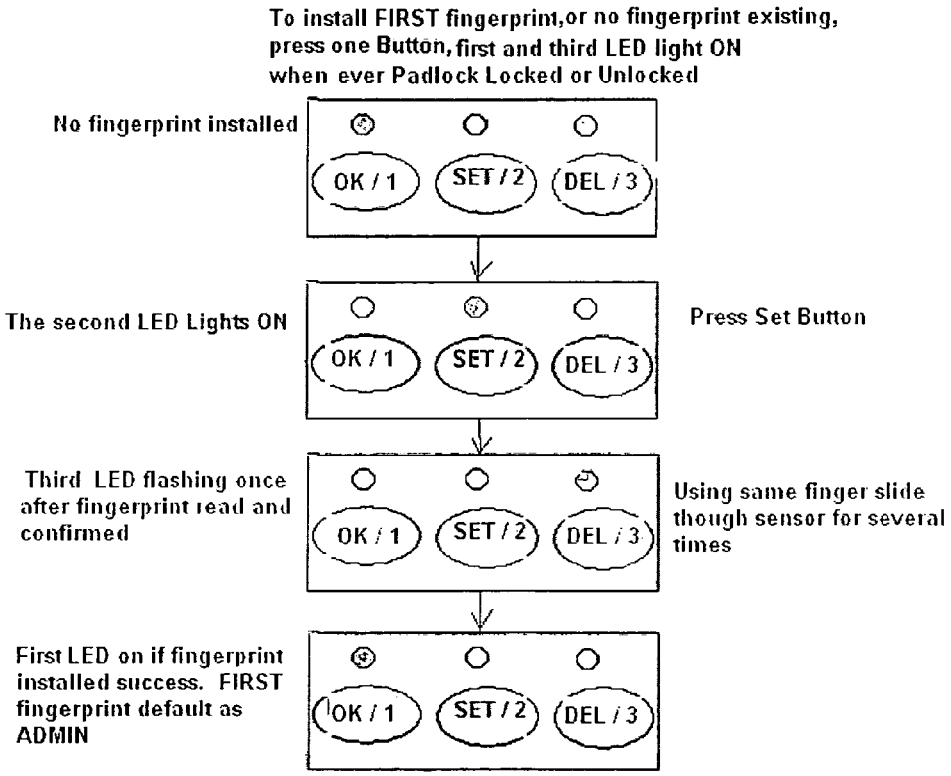
FIG. 7 is a flow diagram of the first installation for the user or fingerprint, and an instruction for the operation of the padlock device of the present invention.

As shown in the flow diagram and instruction of first installation on FIG. 7, pressing one buttons 6 of the keypad, the padlock device 1 will be waked up. There is first LED light if red and third LED light if green will be on with no fingerprint existing in the padlock device 1. Pressing the SET/2 button, the second LED if orange lights on and flashing after 2 sec. The user can slide the finger few times though the sensor 8 at the side of the padlock device. The second LED orange light will be off and third LED green light flashed once if the sensor 8 reads confirmed. The first LED red light will be on when the device is ready for the next installation or have the installation successful. The first user or fingerprint will be an ADMIN as default. It can manage the padlock device to set and delete the fingerprint.

Figure 8:
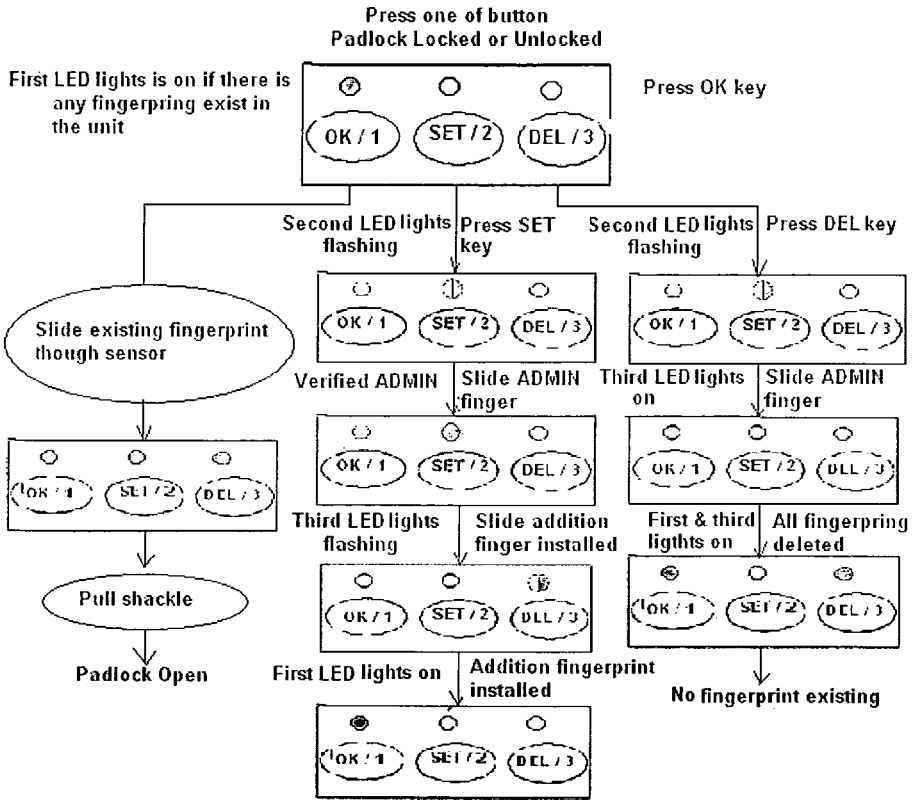
FIG. 8 is a flow diagram of the second, up to 10 user or fingerprint, installation and instruction of the padlock device of the present invention.

On the FIG. 8, it shows the flow diagram and instruction of second installation or the padlock device 1 contains the existing fingerprint. The second installation has to be following the first installation from FIG. 7. The additional new installation has to be also following the process on which the ADMIN fingerprint read first and confirmed with the second LED if orange light. Pressing the SET/2 button the second LED orange lights flashing waiting on ADMIN fingerprint read. The second LED light should turn on if the ADMIN fingerprint accepted. The additional new user or finger can slide though the sensor 8 few times until the third LED if green lights on, installation is achieved. The fingerprint can be installed up to 100 times or as defined.

It is the same process as new installation if the user or fingerprint likes to delete the existing fingerprint. Waking up the device with OK button, pressing the DEL/3 button, the second LED if orange lights flashing. Slide the ADMIN finger though the sensor. All fingerprints of ADMIN and users are deleted after the third LED if green lights on. It has to start installation from the beginning as the flow diagram of the installation of the first user or fingerprint, show on FIG. 7.

To lock the device, the user has to close or press down the shackle. The padlock device should be locked after seeing, the third LED green light on once.

If holding the OK button for a longer time, waiting on the system ready with the second LED if orange lights on, and then punching the combination code to the buttons 6, the fingerprint padlock can be unlocked. At the same process, if holding OK and DEL button for a longer time, punching the combination code to the buttons 6. The fingerprint in the device will be deleted.

Although the present invention has been described with the reference to particular preferred embodiments, it is to be understood that the embodiments are merely illustrative of the principles and application of the present invention. It is to be understood that numerous modifications may be made to the preferred embodiments and that other arrangements may be devised without departing from the spirit and scope of the present invention as defined by the claims.

What is claimed is:

1. A lock comprising:

(A) a case body;

(B) a shackle connected to the case body movable in a bore;

(C) a sliding block connected to the case body with an end spring switching between an immobile state in which the shackle is immobilized in the bore and a mobile state in which the shackle is movable under an external force;

(D) a major electromagnetic switch system controlling the movement of the sliding block and including (1) a body comprising a solenoid and a magnet;

(2) a rod movable inside the solenoid between a first rod position in which the sliding block is immobilized and a second rod position in which the sliding block is mobile;

(3) an end cap block mounted flexibly on the rod of the major electromagnetic switch stabilizing the sliding blocking and reducing the force from the sliding block on the rod of the major switch;

(E) a minor electromagnetic switch system including (1) a solenoid body;

(2) a rod movable inside the solenoid;

(3) a stop plate mounted on the case body, and the slot of the stop plate floated on the rod of the minor electromagnetic switch with a spring; the stop plate is movable between a first plate position in which the rod of the major electromagnetic switch system is immobilized and a second plate position in which the rod of the major electromagnetic system is mobile;

(F) a return switch with a return block attached by a return spring to apply a locking signal to the major electromagnetic switch when pushed down by the shackle;

(G) a power source from which the power should be shut off if no operation within a predetermined amount of time.

2. The lock as claimed in claim 1 wherein (A) after receiving a locking signal, the rod of the major electromagnetic switch moves to the first rod position in which the stop plate of the minor electromagnetic switch is sprung into the first plate position under the end of the rod of the major electromagnetic switch to block the movement of the rod of the major electromagnetic switch;

(B) after receiving an unlocking signal, the rod of the minor electromagnetic switch pulls the stop plate to the second plate position in which the rod of the major electromagnetic switch moves to the second rod position; the sliding block with an end spring force against the shackle at vertical direction is mobile and the shackle can be pulled up by an external force;

(C) the end cap has a flexibly connection with the rod of the major electromagnetic switch and follows the movement of the rod of the major electromagnetic switch;

(D) the return block switching between an immobile state in which the shackle is immobilized in the bore and a mobile state in which the shackle is movable under an external force.

3. The lock as claimed in claim 1 wherein the power source includes alkaline batteries locating in an isolated compartment of the case body.

4. The lock as claimed in claim 1 being a padlock, safety box lock, door lock, cabinet lock or draw lock.

5. The lock as claimed in claim 1 further comprising: a fingerprint or combination code user interface operable whether the shackle is at a locked position or an unlocked position and including (A) a fingerprint sensor;

(B) operating buttons;

(C) LED's for indication of fingerprint installation, locking status, power on/off status or low battery status;

(D) memory portion for storing registered fingerprints or combination codes (E) a microprocessor IC comparing the input fingerprint or combination code with the registered fingerprints or combination codes;

(F) a user interface software operation system.

6. The lock as claimed in claim 5 wherein (A) an unlocking signal applies to the minor electromagnetic switch if the input fingerprint matches the stored fingerprints in the memory or the input combination code matches the combination codes in the memory; then after a predetermined amount of time, an unlocking signal applies to the major electromagnetic switch as well;

(B) a locking signal applies to the major electromagnetic switch when the return switch is pushed down by the shackle through the return block;

(C) locking or unlocking signal is turned off after a predetermined time to save energy.

7. The lock as claimed in claim 5 wherein the replacement of the power source does not affect the installed fingerprints or combination codes.

8. The lock as claimed in claim 5 wherein the operating buttons functioning as the control for fingerprint installation and management.

9. The lock as claimed in claim 5 wherein the operating buttons functioning as the control for combination code installation and management.

10. The lock as claimed in claim 5 wherein (A) additional fingerprint can be installed after administrator fingerprint has been verified;

(B) the stored fingerprint or combination code can be deleted after administrator fingerprint has been verified.

* * * * *